United States Patent [19]

Rock

[11] 4,089,522

[45] May 16, 1978

[54] HINGE ASSEMBLY

[76] Inventor: Kenneth Maclean Rock, 81 Richmond Road, Morningside, Queensland 4170, Australia

[21] Appl. No.: 605,150

[22] Filed: Aug. 15, 1975

[30] Foreign Application Priority Data

Aug. 16, 1974 Australia ..... 8548/74

[51] Int. Cl.[2] ..... A63B 39/00

[52] U.S. Cl. ..... 273/30; 108/6; 108/112; 108/115

[58] Field of Search ..... 273/30; 108/6, 111, 108/112, 115, 117, 113, 121, 160, 125–133, 8, 59; 16/166, 179; 297/159

[56] References Cited

U.S. PATENT DOCUMENTS

| | | | |
|---|---|---|---|
| 510,858 | 12/1893 | Hastings | 108/160 |
| 3,267,885 | 8/1966 | Shore | 108/112 |
| 3,823,938 | 7/1974 | Unno | 273/30 |

FOREIGN PATENT DOCUMENTS

| | | | |
|---|---|---|---|
| 1,261,208 | 1/1972 | United Kingdom | 273/30 |

*Primary Examiner*—Richard J. Apley
*Assistant Examiner*—T. Brown
*Attorney, Agent, or Firm*—DeLio and Montgomery

[57] ABSTRACT

A hinge mechanism for connecting a surface panel such as a table top to a support frame and operative to guide the panel for pivotal movement about a horizontal axis between a stowed upright attitude adjacent a vertical datum plane and a horizontal operative attitude, the hinge comprising a first link pivoted at a first point to the panel and to the support frame and a second link pivoted to the panel at a point spaced from the first pivot and operatively connected to the first link through a bearing which is slidable in slots, in the first link and in a guide plate, to provide positive triangular guidance and support for the panel, with respect to the frame, in each of the panel's adjusted positions. Additional side panels and/or ball deflecting means may conveniently be added so that a table embodying the hinge mechanism can be used not only for a table tennis game but also for table tennis practice by a single player or for a table squash game by two players; such tables also having general adaptability as picnic tables or the like.

4 Claims, 6 Drawing Figures

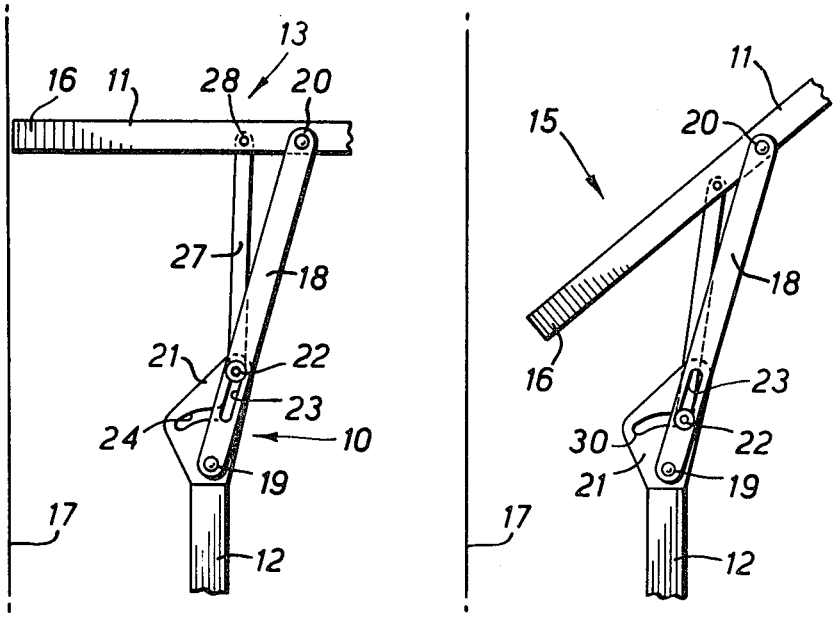
FIG. 1
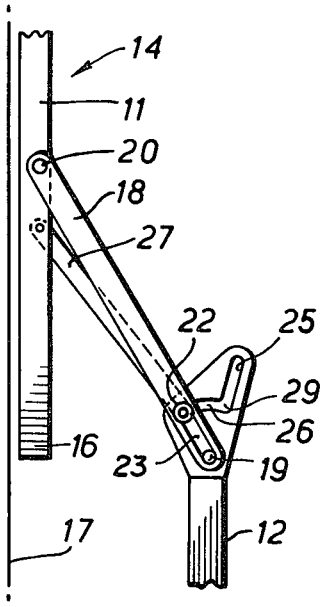

HINGE ASSEMBLY

This invention relates partly to an improved hinge mechanism, and in particular it relates to a hinge mechanism for hinging table-top like panel members between their operative horizontal attitude and to an upright stowed attitude.

At present, there are available many varieties of folding tables. However, most of these simply reduce the size of the table surface, while those that fold up for storage purposes are often cumbersome and inherently unstable. It is an object of this invention to provide a hinge mechanism for a table and which will enable a table or the like to be folded to a stowed attitude in which attitude the stowed table will take up a minimum of space and at the same time will be stable for transport purposes.

Another object of the present invention is to provide an improved foldable extension panel assembly which will extend horizontally in its operative attitude and be foldable to a stowed vertically extending attitude in which the extension panel assembly is stable.

Another object of the present invention is to provide a folding table tennis table which may be arranged in part folded attitude to form a practice table for a single player.

Yet another object of the present invention is to provide apparatus for playing a novel game based on the game squash racquets, utilizing the squash ball and the rules of the game but played with small bats such as table tennis bats. Other objects and advantages of the present inventions will hereinafter become apparent.

With the foregoing an other objects in view, this invention resides broadly in one aspect in a hinge mechanism for connecting a surface panel assembly to a support frame and operative to guide said surface panel assembly for pivotal movement about a transversely extending axis between a stowed upright attitude in which said surface panel assembly is positioned adjacent a vertically extending datum plane disposed parallel to said axis and at the side of said surface panel remote from said hinge mechanism and in which stowed attitude said surface panel assembly has a lowermost edge and an uppermost edge, to an operative position in which said surface panel assembly extends substantially horizontally and is positioned with said lowermost edge contained in said datum plane and said uppermost edge at the side of said hinge mechanism remote from said lowermost edge, said hinge mechanism including a first linkage assembly having an upper pivot assembly adapted for connection to said surface panel assembly and a lower pivot assembly adapted for connection to said support frame and control means associated with said linkage assembly and arranged to operatively position said linkage assembly with respect to said support frame in relation to the relative pivotal position between said surface panel and said linkage assembly.

The present invention also resides in apparatus for playing a ball game comprising a substantially horizontal base panel adapted to be elevated above the floor supporting the players, a rear upstanding end wall at one end of said base panel and a pair of spaced apart side panels enclosing said base panel and said rear wall and a definitive panel adjacent the junction of said base panel and said rear wall and extending between said side walls and said definitive panel being inclined to and positioned in abutting relationship with said rear wall and said base panel.

To illustrate the invention, particular reference will be made to a table tennis table utilising the invention. However, the hinge mechanism of the invention may be equally applied to other types of table such as for foldable extension panels or for covering hatches or the like which may be folded advantageously in a similar manner.

In order that the invention may be more readily understood and put into practical effect, reference will now be made to the accompanying drawings wherein:

FIG. 1 is a series of views illustrating the operation of the preferred hinge mechanism made in accordance with the present invention;

Figure 2:
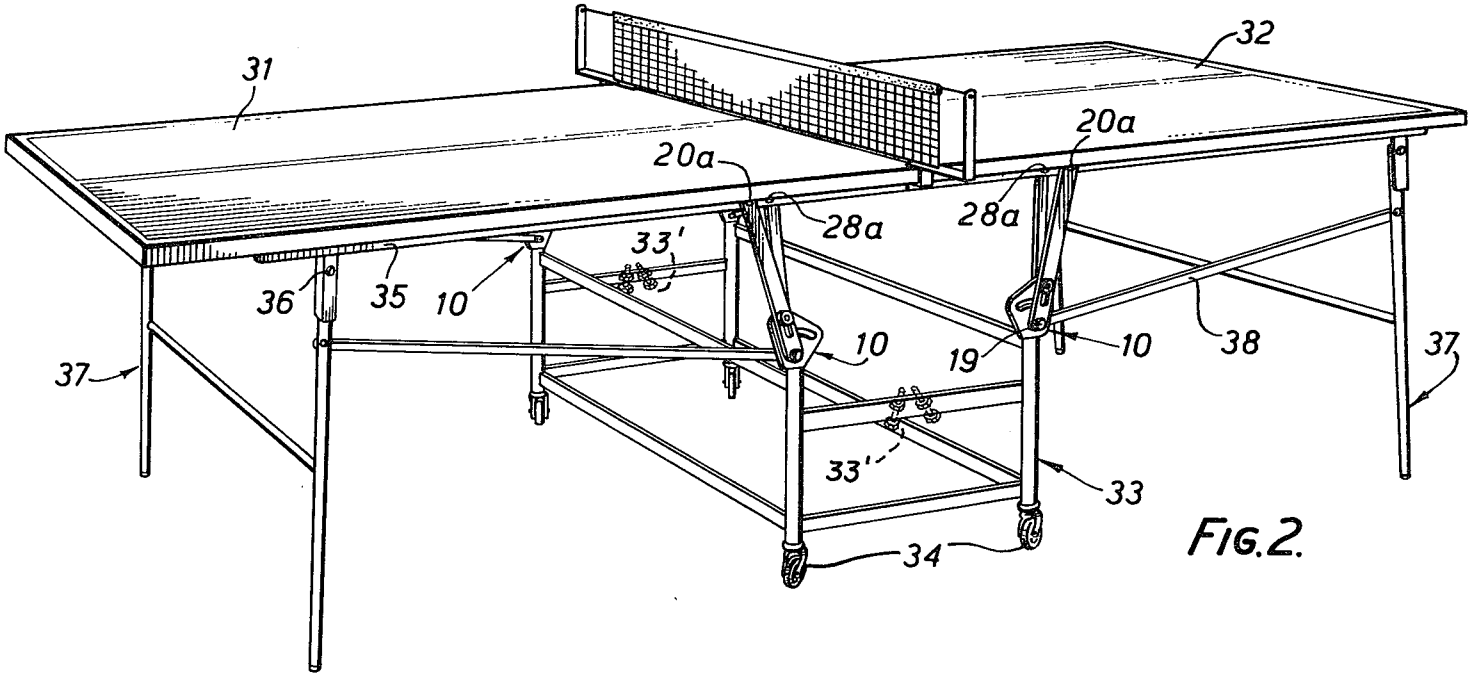
FIG. 2 is a perspective view of a foldable table tennis table constructed in accordance with the present invention.

As shown in FIG. 1, the hinge mechanism 10 is adapted to connect a panel member 11 to a support frame 12 and operable to guide the panel member 11 for pivotal movement through approximately ninety degrees from an operative attitude as shown at 13 to a stowed position as shown at 14. In the position 15, intermediate the positions 13 and 14, it will be seen that the end 16 of the panel member 11 has moved inwardly from a vertically extending transverse reference plane 17 disposed in fixed relationship with the support frame 12.

As shown the hinge mechanism 10 comprises a first linkage member 18 connected pivotally at its ends to the support frame at 19 and the surface panel at 20. The linkage member 18 is arranged for pivotal movement about the lower pivot 19 and such pivotal movement is controlled by means of a bearing assembly 22 which co-operates in a longitudinally extending cut-out 23 formed in the linkage 18 and in a co-acting slot 24 formed in a guide plate 21 fixed to the support frame 12. The slot 24 comprises a first linear guide slot 25 adapted, when the panel member 11 is disposed in its operative attitude as shown at 13, to extend congruently with the cut-out 23, and an arcuate control slot 26 connecting with the lower portion of the slot 25 and arranged radially about the lower pivot 19.

The bearing assembly 22 is also connected to the lower end of an upwardly extending control stay 27 the upper end of which is connected at 28 to the panel member 11 at a position spaced from the pivot 20 towards the reference plane 17. The control stay 27 is of such length that when the panel member 11 is disposed in its operative attitude the bearing 22 is positioned operatively in the upper portions of the guide slot 25 and the cut-out 23. In this position the bearing assembly 22 prevents the linkage member 18 pivoting about the lower pivot 19 so that initial pivotal movement of the panel member 11 occurs only about the upper pivot 20. The guide plate 21, bearing assembly 22, control stay 27, cutout 23, guide slot 25 and the control slot 26 constitute control means.

Initial pivoting of the panel member 11 is accompanied by a downward movement of the control stay 27 so that the bearing assembly 22 is moved down the congruently arranged guide slot 25 and the cut-out 23 until it registers in the lead portion 29 of the control slot 26. At this position the surface panel 11 is disposed as shown at 15. Further pivotal movement of the panel member 11 towards its folded attitude will cause the linkage member 18 to pivot about its lower pivot 19 and the bearing assembly 22 to move in fixed relationship to the member 18 along the control slot 26. In so doing the bearing assembly 22 is restrained for pivotal movement about the pivot 19 and longitudinal movement along the linkage 18 is prevented.

Thus the panel member 11 is effectively maintained in rigid relationship with the linkage 18 by the effective triangulation formed between the linkage 18, the control stay 27 and the panel member 11, all of which are held in fixed relationship. Thus, when the bearing assembly 22 abuts the trailing end 30 of the control slot 26, or is otherwise restrained, the panel member 11 extends upwardly as shown at 14 in its stowed attitude and is maintained in this position by gravitational forces tending to cause pivotal movement of the panel member 11 and linkage assembly 18 about the pivot 19. As this movement is prevented the surface panel is stable in its stowed attitude.

In the illustrated embodiments adjustable screw stops 33' are arranged on the support frame to position the lowermost end 16 of the panel member 11. Also, while the guide slot 25 is arranged in two definite parts, it could be a continuous slot formed to give simultaneous movement about both ends of the member 18. The geometry could also be arranged so that the ends 16 of the panel members 11 move in a vertical plane.

It will be seen that in the illustrated embodiment the geometry of the hinge mechanism is arranged so that the table tops are spaced apart in their stowed attitude. Thus side flaps or extension end flaps may be incoporated to increase the length or the width of the table, and such flaps would be hinged for folding on the the top surface portions of the panel members prior to folding as there is sufficient space between the panel members in their stowed attitude to accommodate the additional flaps.

Figure 3:
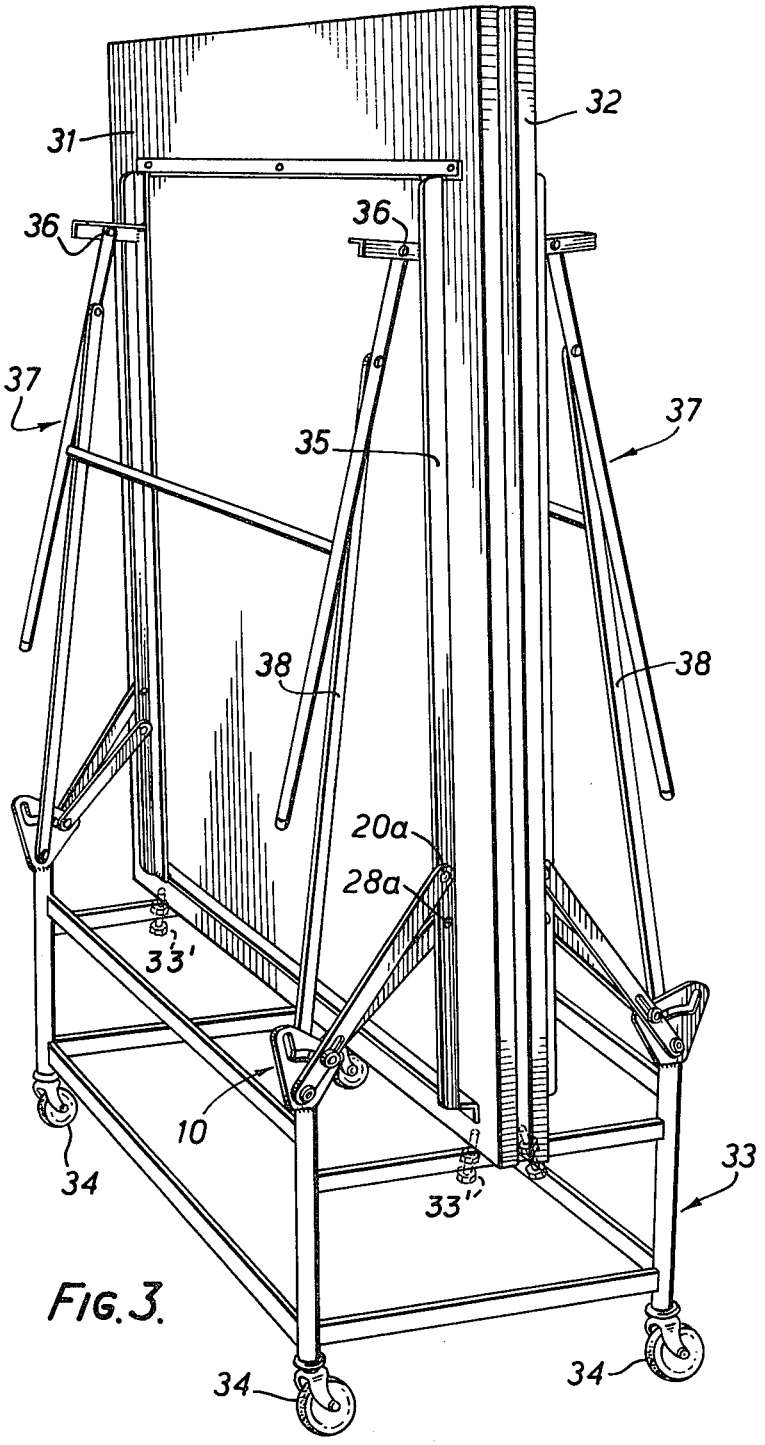
FIG. 3 is a view of the table disposed in folded attitude.
Figure 4:
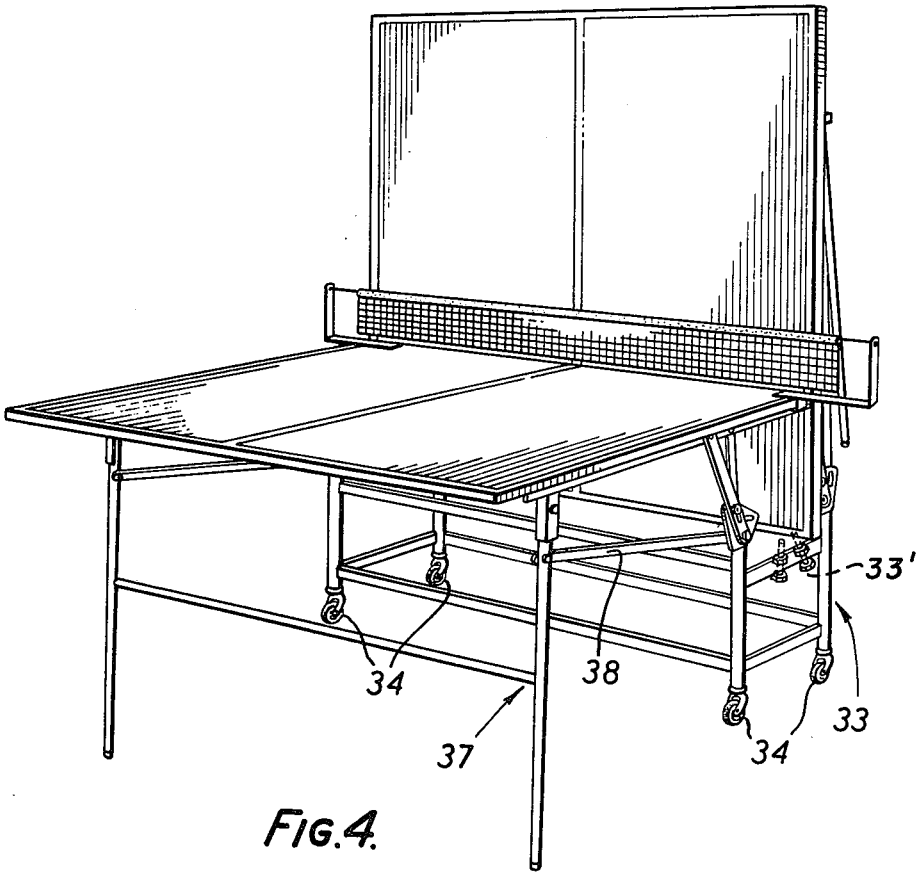
FIG. 4 is a view of the table illustrated in part folded attitude.
Figure 5:
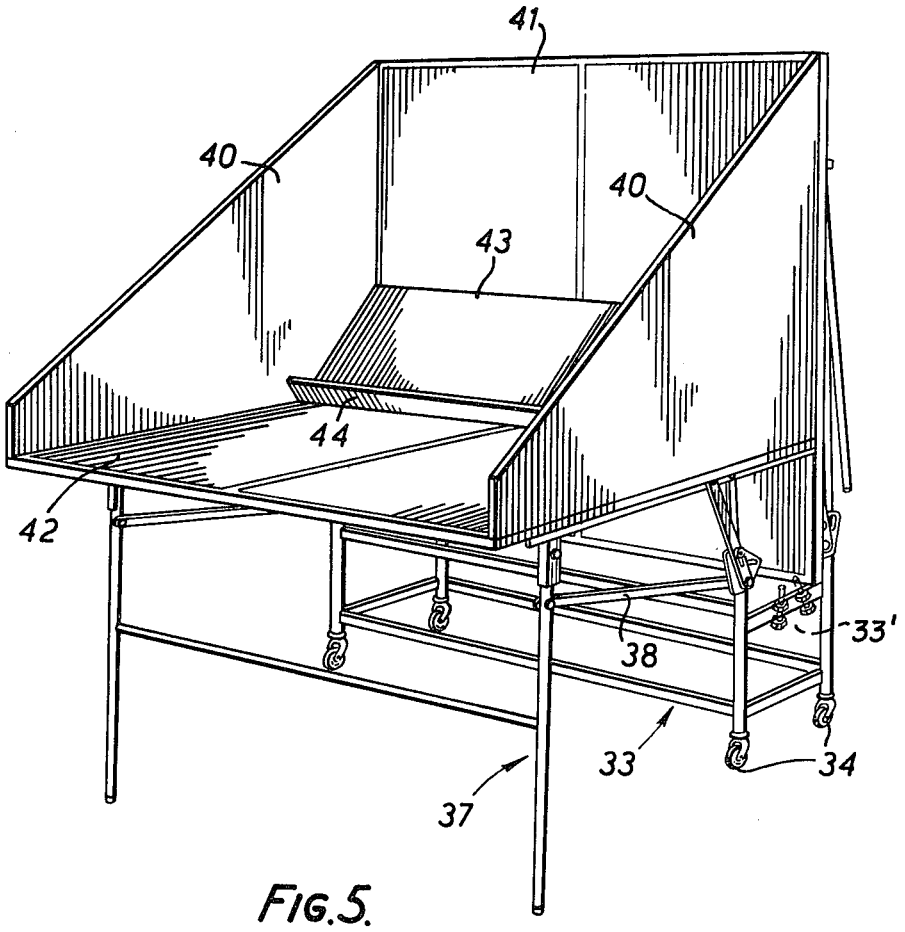
FIG. 5 illustrates the table arranged for use as a table squash table.

The hinge mechanism substantially as described above may be used advantageously for controlling the pivotal movement of the respective halves of a table tennis table. In this respect, FIGS. 2 to 4 illustrate a table tennis table made in accordance with the present invention and embodying the hinge mechanisms as described above.

As shown, the table tennis table of FIG. 2 includes a pair of rectangular panel members 31 and 32 adapted to abut in their horizontally extending attitude at the transverse centre line to form a continuous table surface. Each part 31 and 32 is connected to a mobile support frame 33 by a pair of transversely spaced hinge mechanisms 10. As illustrated in FIG. 1 a panel member supported by a hinge mechanism 10 according to the present invention is foldable from a horizontal operative attitude to a stable vertically extending stowed attitude without the end 16 of the panel passing beyond a reference plane coinciding with the end 16 of the panel when the latter is disposed in its operative attitude. Thus in the table illustrated in FIG. 2, either or both of the panels 31 or 32 may be folded independently or simultaneously to a stowed attitude as shown in FIG. 3 in which the panels extend upwardly and are disposed within the vertical boundaries of the mobile support frame 33 which is a rectangular structure supported at its corners on four castor wheels 34. Thus, in its stowed attitude, the table occupies a minimum floor space and is easily movable to its selected storage area.

In the illustrated embodiment the upper pivots **20*a* and 28*a* are formed in a sub-frame 35 to which the table panel proper is connected. Each sub-frame 35 also provides at its end remote from the hinge mechanism 10 a pair of transversely spaced pivots 36 for a support leg assembly 37 adapted to support the outer end of the table panel. Each support leg assembly 37 is further connected to the mobile support frame 33 by an arm 38 connected between the lower pivot 19 of the hinge mechanism 10 and a pivot on the support let assembly 37 spaced downwardly from its pivotal connection 36 to the sub-frame 35**.

Thus, each support leg assembly 37 is effectively connected to the support frame 33 by a converging linkage assembly adapted to maintain the support leg assembly 37 in a vertically extending attitude as the respective panel is folded. Thus, when the table is disposed in its folded attitude the support leg assemblies extend downwardly beside the respective panels and are also contained within the vertical boundaries of the support frame 33. Also in operation, as each panel is folded from its stowed attitude to its operative attitude the respective support leg assembly is automatically positioned operatively to support the outer end of the panel.

The advantage of the present invention beside the stable stowage arrangement already illustrated is that one panel may be folded to its stowed attitude in which it extends perpendicularly adjacent the adjoining edge of the other panel. Thus, as shown in FIG. 4, the table may be used by a single player for practising strokes utilising the ball rebounding from the folded panel to provide continuous playing.

Another aspect of the present invention is the incorporation of removable side walls 40 which are adapted to co-operate with the table when one panel is folded to its stowed attitude as shown in FIG. 4. The side walls 40 co-operate with the mutually perpendicular panels of the table to form a small squash court-like enclosure for the purpose of playing table squash. For this purpose there is provided at the junction of the end wall 41, formed by the folded panel, and the base 42 an angularly disposed member 43 as shown and extending between the side walls 40. This member 43 defines thereabove the playing surface of the end wall 41. A ball directed towards the end wall but which engages the angularly disposed member 43 will be deflected upwards and it will thus be immediately apparent that such is a foul ball. The member 43 is provided at its lower end with an upturned lip 44 so that a ball which rolls down the member 43 will be deflected upwards and returned in bouncing manner to the playing end of the table. As previously mentioned, the game is played by two persons with table-tennis bats and a squash ball and the rules of squash racquets are observed. Of course, the apparatus as shown could be supported on any convenient support frame not necessarily on the foldable table arrangement forming part of the present invention.

Figure 6:
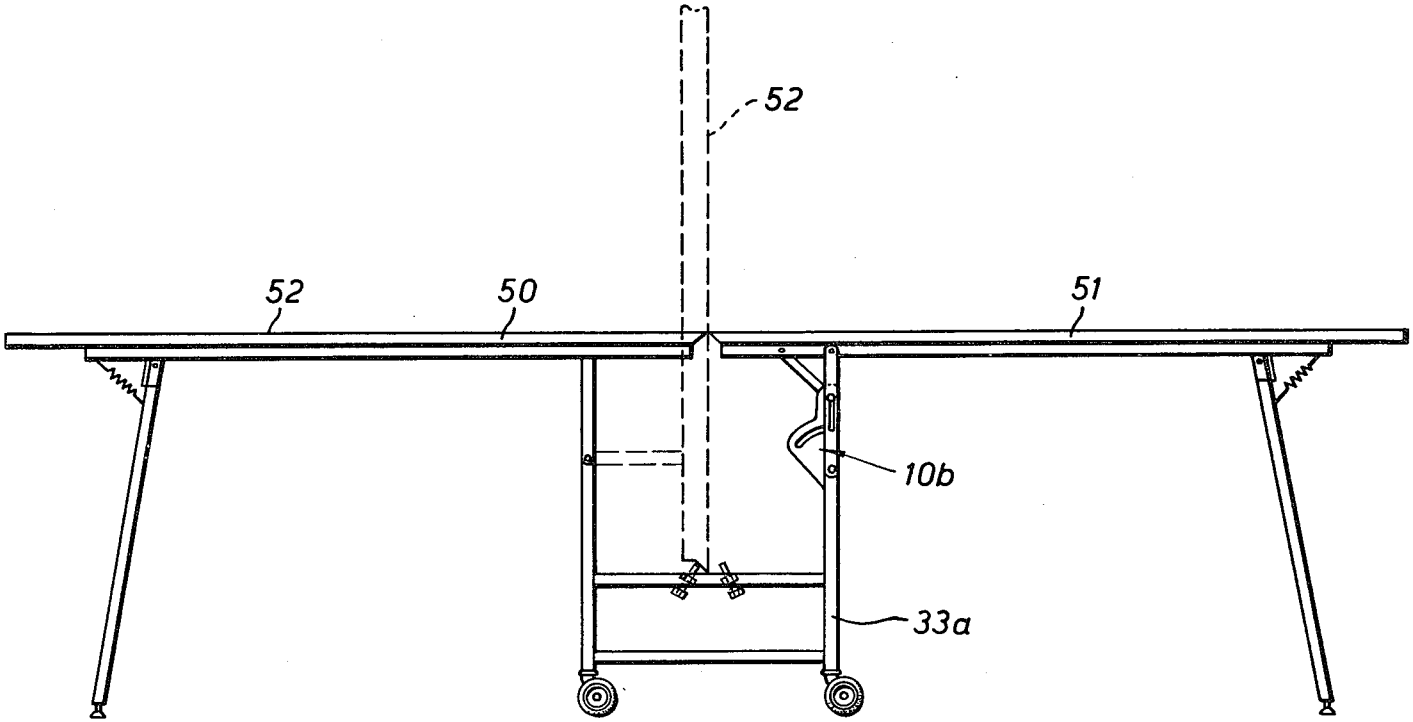
FIG. 6 is a side elevational view of an alternate embodiment of the invention.

FIG. 6 illustrates an alternate embodiment of the invention in which one of the panels 50 of a folding table is connected to the support frame **33*a* by a conventional pivot arrangement. In this arrangement this panel 50 has to be folded to its stowed attitude prior to the panel 51 which is connected to the support frame 33***a* by a hinge mechanism 10*b* according to the present invention. The panel 50 in its stowed attitude is adapted to extend upwardly with its working surface 52 in a plane extending through the junction between the panels 50 and 51.

The foldable extension panel assembly of the present invention can be applied to other apparatus where a large table surface is required, but at the same time conveniently small storage size is essential. For example, catering tables which have to be transported can be made according to the present invention or a mobile barbecue could be provided with such foldable panels.

While the above has been given by way of illustrative example it will, of course, be realised that many modifications of constructional detail and design and applications may be made to the above described embodiments by persons skilled in the art and all such variations are deemed to fall within the broad scope of the present invention and is defined by the appended claims.

I claim:

1. A hinge mechanism connecting a panel assembly to a support frame and operative to guide said panel assembly for pivotal movement about a transversely extending axis between a stowed upright attitude in which said panel assembly is positioned adjacent a vartically extending datum plane disposed parallel to said axis and at the side of said panel remote from said hinge mechanism and in which stowed attitude said panel assembly has a lowermost edge and an uppermost edge, to an operative position in which said panel assembly extends substantially horizontally and is positioned with said lowermost edge substantially contained in said datum plane and said uppermost edge disposed at the side of said hinge mechanism remote from said lowermost edge, said hinge mechanism including an elongated linkage member pivotally connected at one end to the panel assembly and pivotally connected at its other end to the support frame, and control means therefor, said control means including a control stay pivotally connected at a fixed point to the panel assembly and pivotally connected with the support frame and the linkage member, the support frame having a control slot and the linkage member having an elongated cut-out, said control slot has a first portion extending parallel to said cut-out when said linkage member is disposed so as to support said panel assembly in its operative attitude, and a second arcuate portion extending about the pivotal connection between said linkage member and said support frame said last named pivoted connection comprising a bearing assembly on the control stay said bearing assembly extending through and slidable along said control slot and said cut out, said control stay being functional to allow movement of said bearing assembly along said cut-out and said first portion of said control slot, thus preventing pivotal movement of said linkage member relative to said support frame, to said second arcuate portion of said support frame, to said second arcuate portion of said control slot in which said pivotal movement between said linkage member and said support frame is permitted, the relation of said bearing assembly, control slot and cut-out being such that, during initial pivoting of the panel assembly from its operative position to its stowed position, the panel assembly pivots only about its connection at said one end of the linkage member, to move said bearing assembly along said cut-out and said first portion of said control slot whereafter said bearing assembly enters said second portion of the control slot so disposed as to permit the linkage member to move pivotally around the connection of its other end to the support frame while the panel assembly moves to its stowed attitude adjacent said datum plane.

2. A hinge mechanism according to claim 1, wherein said linkage member is connected to said panel assembly at a position spaced longitudinally from the pivotal connection between said control stay and said panel assembly.

3. A hinge mechanism according to claim 1, wherein a pair of spaced apart hinge mechanisms and a panel assembly are disposed said on each side of a common datum plane each said panel assembly being connected to said common support frame by means of said hinge mechanisms, said panel assemblies and said hinge mechanisms being symmetrically connected with respect to said datum plane.

4. A hinge mechanism according to claim 3, wherein each said panel assembly is supported at its lower end, when in stowed attitude, by an adjustable abutment means on said support frame, whereby the stowed position of each panel assembly in relation to said support frame may be selectively varied.

* * * * *